US010037740B2

(12) United States Patent
Huang

(10) Patent No.: US 10,037,740 B2
(45) Date of Patent: Jul. 31, 2018

(54) GOA CIRCUIT AND LIQUID CRYSTAL DISPLAY DEVICE

(71) Applicant: SHENZHEN CHINA STAR OPTOELECTRONICS TECHNOLOGY CO., LTD., Guangdong (CN)

(72) Inventor: Xiaoyu Huang, Guangdong (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 110 days.

(21) Appl. No.: 15/307,219

(22) PCT Filed: Mar. 31, 2016

(86) PCT No.: PCT/CN2016/078005
§ 371 (c)(1),
(2) Date: Oct. 27, 2016

(87) PCT Pub. No.: WO2017/140014
PCT Pub. Date: Aug. 24, 2017

(65) Prior Publication Data

US 2018/0047359 A1 Feb. 15, 2018

(30) Foreign Application Priority Data

Feb. 18, 2016 (CN) ..... 2016 1 0089925

(51) Int. Cl.
*G09G 3/36* (2006.01)

(52) U.S. Cl.
CPC ..... *G09G 3/3677* (2013.01); *G09G 3/3648* (2013.01); *G09G 3/3696* (2013.01);
(Continued)

(58) Field of Classification Search
CPC ..... G09G 3/3677; G09G 2310/0286; G09G 2300/0408; G09G 2310/0289; G09G 3/3674
(Continued)

(56) References Cited

U.S. PATENT DOCUMENTS 6,421,038 B1 * 7/2002 Lee ..... G09G 3/3677 345/87
9,078,301 B2 * 7/2015 Li ..... H05B 37/02
(Continued)

FOREIGN PATENT DOCUMENTS

CN 101587700 A 11/2009
CN 202473180 U 10/2012
(Continued)

OTHER PUBLICATIONS

English abstract translation of CN103258514.
(Continued)

*Primary Examiner* — Koosha Sharifi-Tafreshi
(74) *Attorney, Agent, or Firm* — WPAT, PC

(57) ABSTRACT

A GOA circuit and a liquid crystal display device are provided. The GOA circuit includes a plurality of gate driving modules for inputting scanning signals to scanning lines. Each of the gate driving modules includes a GOA unit and an output control unit. The output control unit includes a first control shunt, a second control shunt, a third control shunt, and a fourth control shunt.

14 Claims, 3 Drawing Sheets

(52) U.S. Cl.
CPC ..... *G09G 2300/0408* (2013.01); *G09G 2310/0289* (2013.01); *G09G 2310/08* (2013.01)

(58) Field of Classification Search
USPC ..... 345/98, 100
See application file for complete search history.

(56) References Cited

U.S. PATENT DOCUMENTS

| | | | | |
|---|---|---|---|---|
| 9,721,523 | B2 * | 8/2017 | Shin | G09G 3/3677 |
| 2009/0184914 | A1 | 7/2009 | Han et al. | |
| 2015/0154927 | A1 | 6/2015 | Li | |

FOREIGN PATENT DOCUMENTS

| | | | |
|---|---|---|---|
| CN | 103258514 | A | 8/2013 |
| CN | 105118472 | A | 12/2015 |

OTHER PUBLICATIONS

English abstract translation of CN101587700.
English abstract translation of CN202473180.
English abstract translation of CN105118472.

* cited by examiner

GOA CIRCUIT AND LIQUID CRYSTAL DISPLAY DEVICE

BACKGROUND OF THE INVENTION

1. Field of the Invention

The present invention relates to a field of display technology, and more specifically to a GOA (Gate Driver on Array) circuit and a liquid crystal display (LCD) device.

2. Description of the Prior Art

With the development of thin film transistor liquid crystal displays (TFT-LCDs), the TFT-LCDs have become an important display platform in modern information technology (IT) and video products; also, user's requirements are higher and higher. GOA technology has developed rapidly in order to meet the requirements of narrow bezel and low cost.

During an actual driving, the drop of the output of a gate voltage changes quickly to impact a reference voltage within a panel, and there is a positive correlation between the extent of the impact and the change of voltage per unit time. In the design of traditional architectures, the output of a gate can be shaded by the design of a printed circuit board (PCB). That is, a high level is declined to the time extension of a low level to reduce an impact on a reference voltage. FIG. 1 is a waveform diagram of the output of a shaded gate voltage, in which the high level thereof can be V2 (e.g., 33V), and the low level thereof can be V1 (e.g., −7V). However, in the GOA technology, the output voltage of the gate is not shaded by the design of the PCB since the gate input voltage thereof is generated on an array substrate, thereby the reference voltage of an LCD device according to an existing GOA technology is easily impacted, and thus display effects are reduced.

Therefore, there is a need to provide a GOA circuit and an LCD device, so as to overcome the disadvantage in the prior art.

SUMMARY OF THE INVENTION

An object of the present invention is to provide a GOA circuit and an LCD device which can solve the technical problems of the reduction of display effects caused by not extending the fall time of a gate input voltage so as to easily impact a reference voltage in an LCD device according to an existing GOA technology.

To overcome the above-mentioned disadvantages, the present invention provides a GOA circuit including a plurality of gate driving modules for inputting scanning signals to scanning lines. Each of the gate driving modules includes:

a GOA unit for providing an initial scanning voltage; and an output control unit connecting to the GOA unit, the output control unit including:

a first control shunt for controlling a switch scanning voltage, which is associated with the initial scanning voltage, outputted by each of the gate driving modules, wherein the first control shunt includes a first thin film transistor;

a second control shunt for controlling a switch scanning voltage, which is not associated with the initial scanning voltage, outputted by each of the gate driving modules, wherein the second control shunt includes a second thin film transistor;

a third control shunt which is used for controlling the turning-on of the first control shunt when each of the gate driving modules is in a first working mode, and is used for controlling the turning-on of the second control shunt when each of the gate driving modules is in a second working mode, wherein each of the gate driving modules has the first working mode, the second working mode, and a third working mode, and the third control shunt includes a third thin film transistor; and a fourth control shunt which is used for controlling the output of the initial scanning voltage when each of the gate driving modules is in the third working mode, wherein the fourth control shunt includes a fourth thin film transistor, wherein the controlled voltage has a high level and a low level, and the initial scanning voltage also has a high level and a low level; the first thin film transistor is a PNP type thin film transistor, the second thin film transistor is an NPN type thin film transistor, the third thin film transistor is an NPN type thin film transistor, and the fourth thin film transistor is a PNP type thin film transistor.

In the GOA circuit of the present invention, the output control unit has a control voltage and a high level power; the first thin film transistor includes a first input terminal, a first control terminal, and a first output terminal; the second thin film transistor includes a second input terminal, a second control terminal, and a second output terminal; the third thin film transistor includes a third input terminal, a third control terminal, and a third output terminal; the fourth thin film transistor includes a fourth input terminal, a fourth control terminal, and a fourth output terminal; the first control terminal and the second control terminal connect the control voltage; the first input terminal connects the initial scanning voltage; the first output terminal respectively connects the second output terminal and the third input terminal; the second input terminal connects the high level power; the third control terminal and the fourth control terminal connect the initial scanning voltage; the fourth output terminal connects the fourth control terminal; the third output terminal connects the fourth output terminal; and the fourth output terminal also connects each of the scanning lines.

In the GOA circuit of the present invention, when each of the gate driving modules is in the first working mode, the initial scanning voltage is a high level, the controlled voltage is a low level, and the switch scanning voltage is equal to the initial scanning voltage; when each of the gate driving modules is in the second working mode, the initial scanning voltage is a high level, the controlled voltage is a high level, and the switch scanning voltage is equal to the voltage of the high level power; and when each of the gate driving modules is in the third working mode, the initial scanning voltage is a low level, and the switch scanning voltage is equal to the initial scanning voltage.

In the GOA circuit of the present invention, when each of the gate driving modules is in the first working mode, the first thin film transistor is switched on, the second thin film transistor is switched off, the third thin film transistor is switched on, and the fourth thin film transistor is switched off; when each of the gate driving modules is in the second working mode, the first thin film transistor is switched off, the second thin film transistor is switched on, the third thin film transistor is switched on, and the fourth thin film transistor is switched off; and when each of the gate driving modules is in the third working mode, the third thin film transistor is switched off, and the fourth thin film transistor is switched on.

To overcome the above-mentioned disadvantages, the present invention provides a GOA circuit including a plurality of gate driving modules for inputting scanning signals to scanning lines. Each of the gate driving modules includes:

a GOA unit for providing an initial scanning voltage; and an output control unit connecting to the GOA unit, the output control unit including:

a first control shunt for controlling a switch scanning voltage, which is associated with the initial scanning voltage, outputted by each of the gate driving modules;

a second control shunt for controlling a switch scanning voltage, which is not associated with the initial scanning voltage, outputted by each of the gate driving modules;

a third control shunt which is used for controlling the turning-on of the first control shunt when each of the gate driving modules is in a first working mode, and is used for controlling the turning-on of the second control shunt when each of the gate driving modules is in a second working mode, wherein each of the gate driving modules has the first working mode, the second working mode, and a third working mode; and a fourth control shunt which is used for controlling the output of the initial scanning voltage when each of the gate driving modules is in the third working mode.

In the GOA circuit of the present invention, the output control unit has a control voltage and a high level power; the first control shunt includes a first thin film transistor, the second control shunt includes a second thin film transistor, the third control shunt includes a third thin film transistor, and the fourth control shunt includes a fourth thin film transistor; the first thin film transistor includes a first input terminal, a first control terminal, and a first output terminal; the second thin film transistor includes a second input terminal, a second control terminal, and a second output terminal; the third thin film transistor includes a third input terminal, a third control terminal, and a third output terminal; the fourth thin film transistor includes a fourth input terminal, a fourth control terminal, and a fourth output terminal; the first control terminal and the second control terminal connect the control voltage; the first input terminal connects the initial scanning voltage; the first output terminal respectively connects the second output terminal and the third input terminal; the second input terminal connects the high level power; the third control terminal and the fourth control terminal connect the initial scanning voltage; the fourth output terminal connects the fourth control terminal; the third output terminal connects the fourth output terminal; and the fourth output terminal also connects each of the scanning lines.

In the GOA circuit of the present invention, the first thin film transistor is a PNP type thin film transistor, the second thin film transistor is an NPN type thin film transistor, the third thin film transistor is an NPN type thin film transistor, and the fourth thin film transistor is a PNP type thin film transistor.

In the GOA circuit of the present invention, the controlled voltage has a high level and a low level, and the initial scanning voltage also has a high level and a low level; when each of the gate driving modules is in the first working mode, the initial scanning voltage is a high level, the controlled voltage is a low level, and the switch scanning voltage is equal to the initial scanning voltage; when each of the gate driving modules is in the second working mode, the initial scanning voltage is a high level, the controlled voltage is a high level, and the switch scanning voltage is equal to the voltage of the high level power; and when each of the gate driving modules is in the third working mode, the initial scanning voltage is a low level, and the switch scanning voltage is equal to the initial scanning voltage.

In the GOA circuit of the present invention, when each of the gate driving modules is in the first working mode, the first thin film transistor is switched on, the second thin film transistor is switched off, the third thin film transistor is switched on, and the fourth thin film transistor is switched off; when each of the gate driving modules is in the second working mode, the first thin film transistor is switched off, the second thin film transistor is switched on, the third thin film transistor is switched on, and the fourth thin film transistor is switched off; and when each of the gate driving modules is in the third working mode, the third thin film transistor is switched off, and the fourth thin film transistor is switched on.

The present invention further provides an LCD device which includes:

a GOA circuit including:

a plurality of gate driving modules for inputting scanning signals to scanning lines, each of the gate driving modules including:

a GOA unit for providing an initial scanning voltage; and an output control unit connecting to the GOA unit, the output control unit including:

a first control shunt for controlling a switch scanning voltage, which is associated with the initial scanning voltage, outputted by each of the gate driving modules;

a second control shunt for controlling a switch scanning voltage, which is not associated with the initial scanning voltage, outputted by each of the gate driving modules;

a third control shunt which is used for controlling the turning-on of the first control shunt when each of the gate driving modules is in a first working mode, and is used for controlling the turning-on of the second control shunt when each of the gate driving modules is in a second working mode, wherein each of the gate driving modules has the first working mode, the second working mode, and a third working mode; and a fourth control shunt which is used for controlling the output of the initial scanning voltage when each of the gate driving modules is in the third working mode.

In the LCD device of the present invention, the output control unit has a control voltage and a high level power; the first control shunt includes a first thin film transistor, the second control shunt includes a second thin film transistor, the third control shunt includes a third thin film transistor, and the fourth control shunt includes a fourth thin film transistor; the first thin film transistor includes a first input terminal, a first control terminal, and a first output terminal; the second thin film transistor includes a second input terminal, a second control terminal, and a second output terminal; the third thin film transistor includes a third input terminal, a third control terminal, and a third output terminal; the fourth thin film transistor includes a fourth input terminal, a fourth control terminal, and a fourth output terminal; the first control terminal and the second control terminal connect the control voltage; the first input terminal connects the initial scanning voltage; the first output terminal respectively connects the second output terminal and the third input terminal; the second input terminal connects the high level power; the third control terminal and the fourth control terminal connect the initial scanning voltage; the fourth output terminal connects the fourth control terminal; the third output terminal connects the fourth output terminal; and the fourth output terminal also connects each of the scanning lines.

In the LCD device of the present invention, the first thin film transistor is a PNP type thin film transistor, the second thin film transistor is an NPN type thin film transistor, the third thin film transistor is an NPN type thin film transistor, and the fourth thin film transistor is a PNP type thin film transistor.

In the LCD device of the present invention, the controlled voltage has a high level and a low level, and the initial scanning voltage also has a high level and a low level; when each of the gate driving modules is in the first working mode, the initial scanning voltage is a high level, the controlled voltage is a low level, and the switch scanning voltage is equal to the initial scanning voltage; when each of the gate driving modules is in the second working mode, the initial scanning voltage is a high level, the controlled voltage is a high level, and the switch scanning voltage is equal to the voltage of the high level power; and when each of the gate driving modules is in the third working mode, the initial scanning voltage is a low level, and the switch scanning voltage is equal to the initial scanning voltage.

In the LCD device of the present invention, when each of the gate driving modules is in the first working mode, the first thin film transistor is switched on, the second thin film transistor is switched off, the third thin film transistor is switched on, and the fourth thin film transistor is switched off; when each of the gate driving modules is in the second working mode, the first thin film transistor is switched off, the second thin film transistor is switched on, the third thin film transistor is switched on, and the fourth thin film transistor is switched off; and when each of the gate driving modules is in the third working mode, the third thin film transistor is switched off, and the fourth thin film transistor is switched on.

In the GOA circuit and the LCD device of the present invention, the fall time thereof is extended (when the drop of a scanning voltage) by adding an output control unit into the output terminal of an existing GOA unit, thereby avoiding an impact on a reference voltage and improving display effects.

DETAILED DESCRIPTION OF THE PREFERRED EMBODIMENTS

Figure 1:
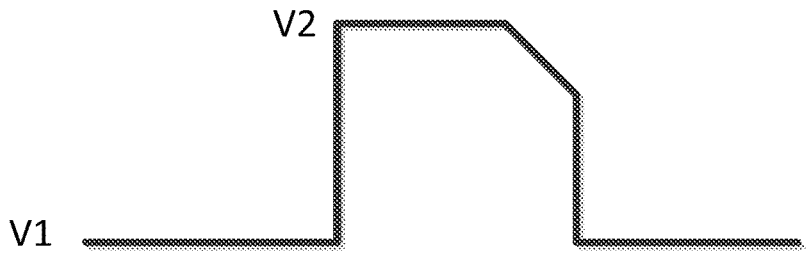
FIG. 1 is a waveform diagram of the output of an existing shaded gate voltage.

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "front", "back", "left", "right", "inside", "outside", "side", etc., is used with reference to the orientation of the figure(s) being described. As such, the directional terminology is used for purposes of illustration and is in no way limiting. Throughout this specification and in the drawings like parts will be referred to by the same reference numerals.

Figure 2:
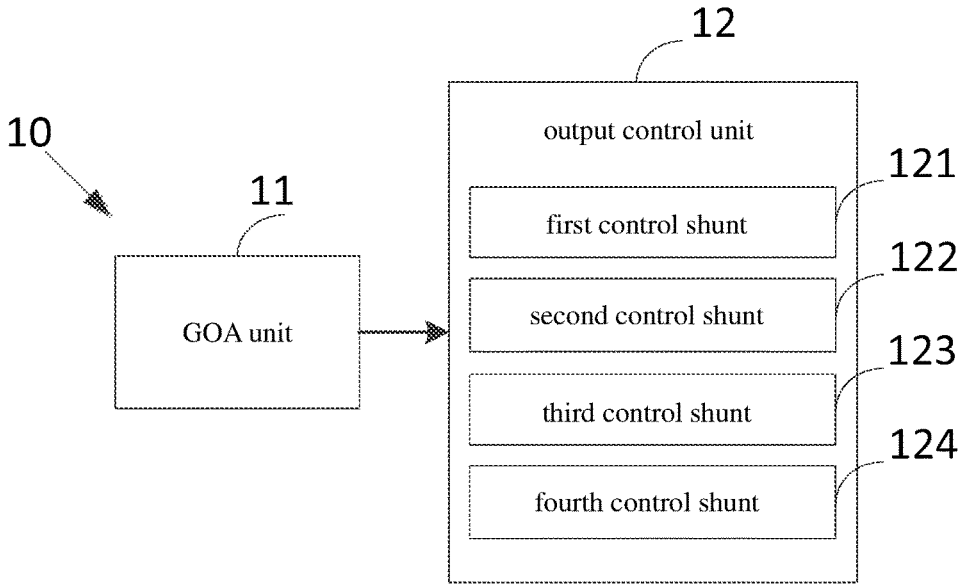
FIG. 2 is a schematic view of a structure of a gate driving module according to the present invention.

Please refer to FIG. 2, which is a schematic view of a structure of a gate driving module according to the present invention.

The GOA circuit of the present invention includes a plurality of gate driving modules. The gate driving modules are used for inputting scanning signals to scanning lines. The number of the gate driving modules is the same as the number of the scanning lines. Each of the gate driving modules 10 includes a GOA unit 11 and an output control unit 12, as shown in FIG. 2. Each of the gate driving modules 10 has a first working mode, a second working mode, and a third working mode.

The GOA unit 11 is used for providing an initial scanning voltage. The output control unit 12 connects the GOA unit 11. The output control unit 12 is used for extending the fall time of the initial scanning voltage during the reduction of the initial scanning voltage. The output control unit 12 includes a first control shunt 121, a second control shunt 122, a third control shunt 123, and a fourth control shunt 124. The first control shunt 121 is used for controlling a switch scanning voltage, which is associated with the initial scanning voltage, outputted by each of the gate driving modules. The second control shunt 122 is used for controlling a switch scanning voltage, which is not associated with the initial scanning voltage, outputted by each of the gate driving modules.

The third control shunt 123 is used for controlling the turning-on of the first control shunt 121 when each of the gate driving modules is in the first working mode, and is used for controlling the turning-on of the second control shunt 122 when each of the gate driving modules is in the second working mode.

The fourth control shunt 124 is used for controlling the output of the initial scanning voltage when each of the gate driving modules is in the third working mode.

Figure 3:
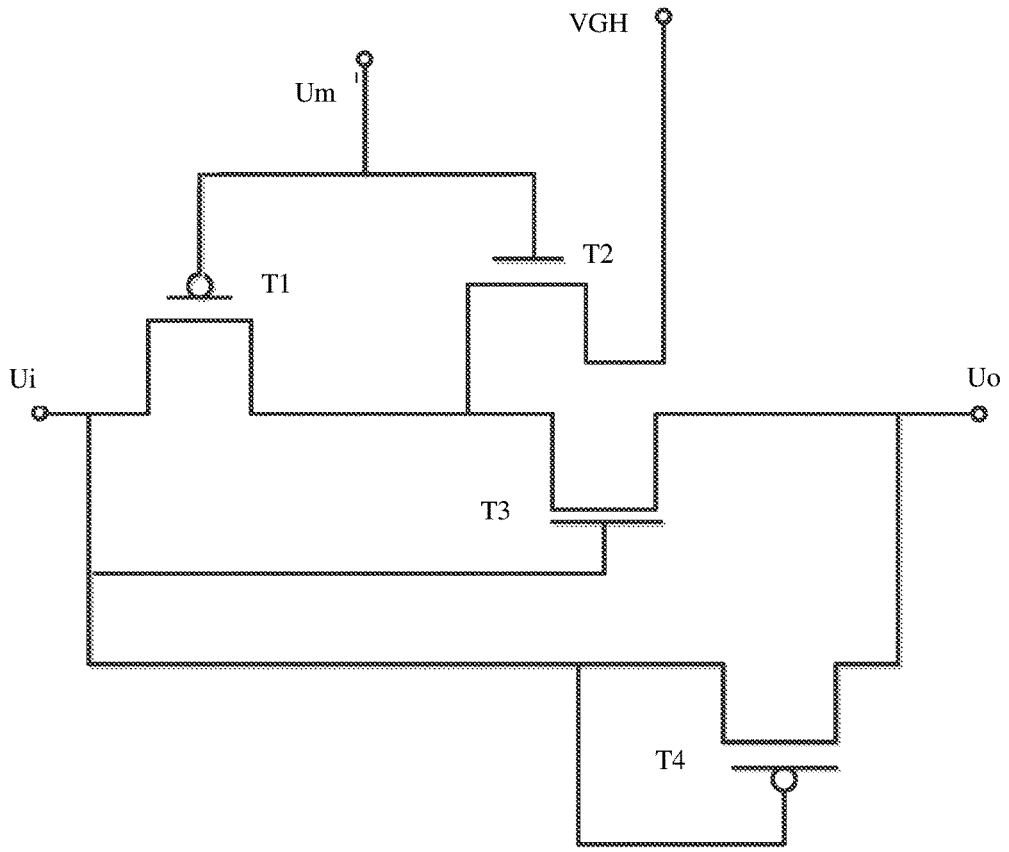
FIG. 3 is a diagram of a circuit of an output control unit according to the present invention.

Specifically, please refer to FIG. 3, the output control unit 12 has a control voltage Um and a high level power.

The first control shunt 121 includes a first thin film transistor T1. The second control shunt 122 includes a second thin film transistor T2. The third control shunt 123 includes a third thin film transistor T3. The fourth control shunt 124 includes a fourth thin film transistor T4.

The first thin film transistor T1 includes a first input terminal, a first control terminal, and a first output terminal. The second thin film transistor T2 includes a second input terminal, a second control terminal, and a second output terminal. The third thin film transistor T3 includes a third input terminal, a third control terminal, and a third output terminal. The fourth thin film transistor T4 includes a fourth input terminal, a fourth control terminal, and a fourth output terminal.

The first control terminal and the second control terminal connect the control voltage Um. The first input terminal connects the initial scanning voltage Ui. The first output terminal respectively connects the second output terminal and the third input terminal. The second input terminal connects the high level power. The third control terminal and the fourth control terminal connect the initial scanning voltage Ui. The fourth input terminal connects the fourth control terminal. The third output terminal connects the fourth output terminal. The fourth output terminal also connects each of the scanning lines (not shown in the figure). That is, the output control unit 12 outputs a switch scanning voltage UO. The voltage value VGH of the high level power can be 15V.

The first thin film transistor T1 is a PNP type thin film transistor. The second thin film transistor T2 is an NPN type thin film transistor. The third thin film transistor T3 is an NPN type thin film transistor. The fourth thin film transistor T4 is a PNP type thin film transistor.

In conjunction with FIG. 2, the control voltage Um has a high level and a low level, and the initial scanning voltage Ui also has a high level and a low level.

Figure 4:
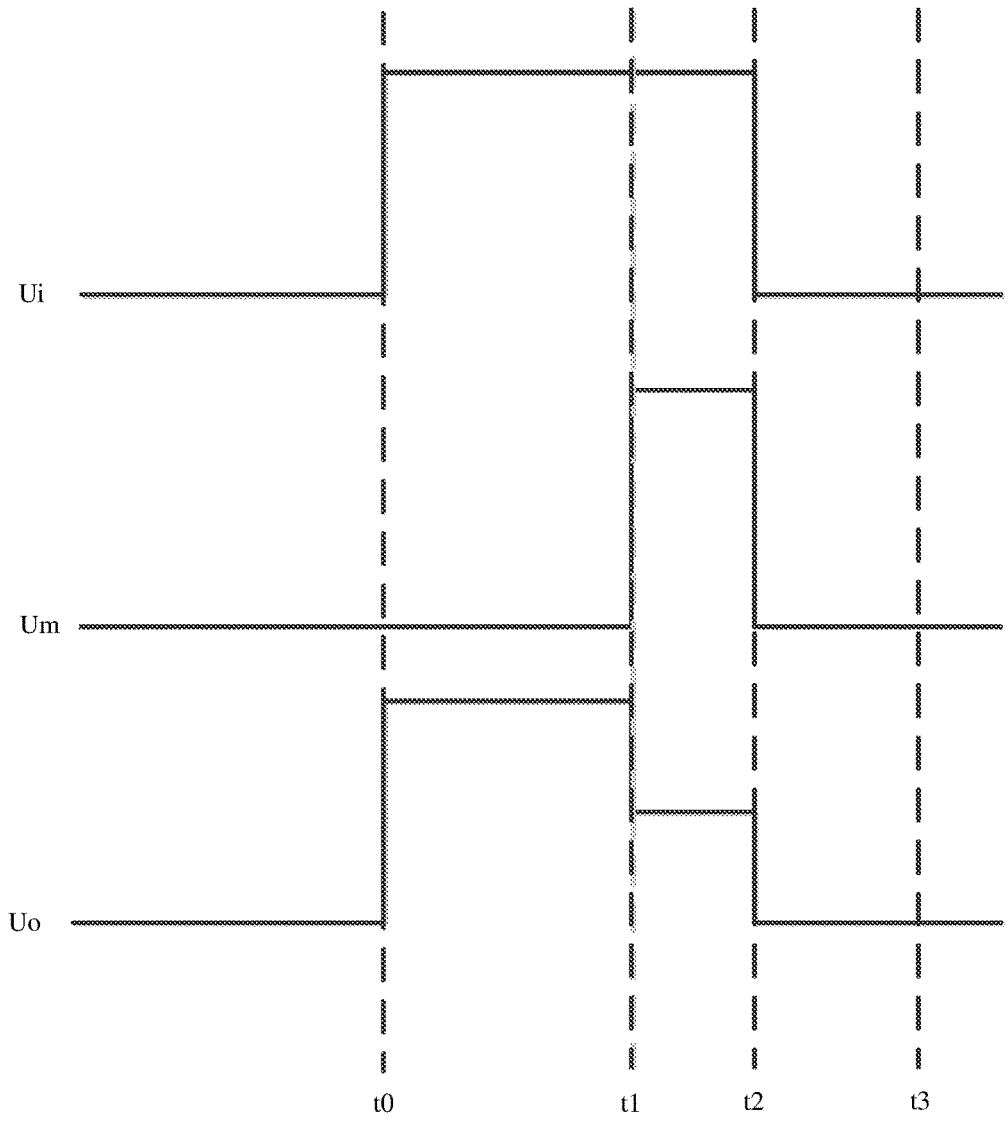
FIG. 4 is a waveform diagram of the output voltage of a GOA circuit according to the present invention.

Please refer to FIG. 4, when each of the gate driving modules is in the first working mode, the initial scanning voltage Ui is a high level, and the control voltage Um is a low level. The third control shunt 123 is in a switching-on state. The fourth control shunt 124 is in a switching-off state. The first control shunt 121 is in a switching-on state. The second control shunt 122 is in a switching-off state. The switch scanning voltage UO is equal to the initial scanning voltage Ui. For example, in a t0-t1 time, Ui is 33V, Um is 0V, and UO is 33V.

When each of the gate driving modules is in the second working mode, the initial scanning voltage Ui is a high level, and the control voltage Um is also a high level. The third control shunt 123 is in a switching-on state. The fourth control shunt 124 is in a switching-off state. The first control shunt 121 is in a switching-off state. The second control shunt 122 is in a switching-on state. The switch scanning voltage UO is equal to the Voltage VGH of the high level power. For example, in a t1-t2 time, Ui is 33V, Um is 33V, and UO is 15V.

When each of the gate driving modules is in the third working mode, the initial scanning voltage Ui is a low level. At this point, the third control shunt 123 is in a switching-off state, the fourth control shunt 124 is in a switching-on state. The switch scanning voltage UO is equal to the initial scanning voltage Ui, whether the control voltage Um is a high level or a low level. For example, in a t2-t3 time, Ui is −7V, and UO is −7V.

In conjunction with FIG. 3, the control voltage Um has a high level and a low level. When each of the gate driving modules is in the first working mode, the first thin film transistor T1 is switched on, the second thin film transistor T2 is switched off, the third thin film transistor T3 is switched on, and the fourth thin film transistor T4 is switched off. When each of the gate driving modules is in the second working mode, the first thin film transistor T1 is switched off, the second thin film transistor T2 is switched on, the third thin film transistor T3 is switched on, and the fourth thin film transistor T4 is switched off. When each of the gate driving modules is in the third working mode, the third thin film transistor T3 is switched off, and the fourth thin film transistor T4 is switched on.

The output voltage of the GOA unit is first reduced to an intermediate value and then is reduced to a minimum value by the output control unit since the output voltage of the GOA unit changes from a high level to a low level, thereby extending the fall time of the output voltage of the GOA circuit, thus avoiding an impact on the reference voltage of an LCD device and improving display effects.

In the GOA circuit of the present invention, the fall time thereof is extended (when the drop of a scanning voltage) by adding an output control unit into the output terminal of an existing GOA unit, thereby avoiding an impact on the reference voltage and improving the display effects.

The present invention further provides an LCD device including an array substrate and a color filter substrate. The array substrate includes a plurality of data lines, a plurality of scanning lines, and a plurality of pixel units defined by the data lines and the scanning lines. The array substrate also includes a GOA circuit. The GOA circuit includes a plurality of gate driving modules. The gate driving modules are used for inputting scanning signals to the scanning lines. The number of the gate driving modules is the same as the number of the scanning lines.

Please refer to FIG. 2, each of the gate driving modules 10 includes a GOA unit 11 and an output control unit 12. Each of the gate driving modules 10 has the first working mode, the second working mode, and the third working mode.

The GOA unit 11 is used for providing an initial scanning voltage. The output control unit 12 connects the GOA unit 11. The output control unit 12 is used for extending the fall time of the initial scanning voltage during the reduction of the initial scanning voltage. The output control unit 12 includes a first control shunt 121, a second control shunt 122, a third control shunt 123, and a fourth control shunt 124. The first control shunt 121 is used for controlling a switch scanning voltage, which is associated with the initial scanning voltage, outputted by each of the gate driving modules. The second control shunt 122 is used for controlling a switch scanning voltage, which is not associated with the initial scanning voltage, outputted by each of the gate driving modules.

The third control shunt 123 is used for controlling the turning-on of the first control shunt 121 when each of the gate driving modules is in the first working mode, and is used for controlling the turning-on of the second control shunt 122 when each of the gate driving modules is in the second working mode.

The fourth control shunt is used for controlling an output of the initial scanning voltage when each of the gate driving modules is in the third working mode.

Specifically, please refer to FIG. 3, the output control unit 12 has a control voltage Um and a high level power.

The first control shunt 121 includes a first thin film transistor T1. The second control shunt 122 includes a second thin film transistor T2. The third control shunt 123 includes a third thin film transistor T3. The fourth control shunt 124 includes a fourth thin film transistor T4.

The first thin film transistor T1 includes a first input terminal, a first control terminal, and a first output terminal. The second thin film transistor T2 includes a second input terminal, a second control terminal, and a second output terminal. The third thin film transistor T3 includes a third input terminal, a third control terminal, and a third output terminal. The fourth thin film transistor T4 includes a fourth input terminal, a fourth control terminal, and a fourth output terminal.

The first control terminal and the second control terminal connect the control voltage Um. The first input terminal connects the initial scanning voltage Ui. The first output terminal respectively connects the second output terminal and the third input terminal. The second input terminal connects the high level power. The third control terminal and the fourth control terminal connect the initial scanning voltage Ui. The fourth input terminal connects the fourth control terminal. The third output terminal connects the fourth output terminal. The fourth output terminal also connects each of the scanning lines (not shown in the figure). That is, the output control unit 12 outputs a switch scanning voltage UO. The voltage value VGH of the high level power can be 15V.

The first thin film transistor T1 is a PNP type thin film transistor. The second thin film transistor T2 is an NPN type thin film transistor. The third thin film transistor T3 is an NPN type thin film transistor. The fourth thin film transistor T4 is a PNP type thin film transistor.

In conjunction with FIG. 2, the control voltage Um has a high level and a low level, and the initial scanning voltage Ui also has a high level and a low level.

Please refer to FIG. 4, when each of the gate driving modules is in the first working mode, the initial scanning voltage Ui is a high level, the control voltage Um is a low level. The third control shunt 123 is in a switching-on state. The fourth control shunt 124 is in a switching-off state. The first control shunt 121 is in a switching-on state. The second control shunt 122 is in a switching-off state. The switch scanning voltage UO is equal to the initial scanning voltage Ui. For example, in a t0-t1 time, Ui is 33V, Um is 0V, and UO is 33V.

When each of the gate driving modules is in the second working mode, the initial scanning voltage Ui is a high level, and the control voltage Um is a high level. The third control shunt 123 is in a switching-on state. The fourth control shunt 124 is in a switching-off state. The first control shunt 121 is in a switching-off state. The second control shunt 122 is in a switching-on state. The switch scanning voltage UO is equal to the Voltage VGH of the high level power. For example, in a t1-t2 time, Ui is 33V, Um is 33V, and UO is 15V.

When each of the gate driving modules is in the third working mode, the initial scanning voltage Ui is a low level. At this point, the third control shunt 123 is in a switching-off state, the fourth control shunt 124 is in a switching-on state. The switch scanning voltage UO is equal to the initial scanning voltage Ui, whether the control voltage Um is a high level or a low level. For example, in a t2-t3 time, Ui is −7V, and UO is −7V.

In conjunction with FIG. 3, the control voltage Um has a high level and a low level. When each of the gate driving modules is in the first working mode, the first thin film transistor T1 is switched on, the second thin film transistor T2 is switched off, the third thin film transistor T3 is switched on, and the fourth thin film transistor T4 is switched off. When each of the gate driving modules is in the second working mode, the first thin film transistor T1 is switched off, the second thin film transistor T2 is switched on, the third thin film transistor T3 is switched on, and the fourth thin film transistor T4 is switched off. When each of the gate driving modules is in the third working mode, the third thin film transistor T3 is switched off, and the fourth thin film transistor T4 is switched on.

The output voltage of the GOA unit is first reduced to an intermediate value and then is reduced to a minimum value by the output control unit since the output voltage of the GOA unit changes from a high level to a low level, thereby extending the fall time of the output voltage of the GOA circuit, thus avoiding an impact on the reference voltage of the LCD device and improving display effects.

In the LCD device of the present invention, the fall time thereof is extended (when the drop of a scanning voltage) by adding an output control unit into the output terminal of an existing GOA unit, thereby avoiding an impact on the reference voltage and improving the display effects.

It should be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A gate-driver-on-array (GOA) circuit, comprising: a plurality of gate driving modules for inputting scanning signals to scanning lines, each of the gate driving modules comprising:

a gate-driver-on-array unit for providing an initial scanning voltage; and an output control unit connecting to the gate-driver-on-array unit, the output control unit comprising:

a first control shunt for controlling a switch scanning voltage, which is associated with the initial scanning voltage, outputted by each of the gate driving modules, wherein the first control shunt comprises a first thin film transistor;

a second control shunt for controlling a switch scanning voltage, which is not associated with the initial scanning voltage, outputted by each of the gate driving modules, wherein the second control shunt comprises a second thin film transistor;

a third control shunt which is used for controlling a turning-on of the first control shunt when each of the gate driving modules is in a first working mode, and is used for controlling a turning-on of the second control shunt when each of the gate driving modules is in a second working mode, wherein each of the gate driving modules has the first working mode, the second working mode, and a third working mode, and the third control shunt comprises a third thin film transistor; and a fourth control shunt which is used for controlling an output of the initial scanning voltage when each of the gate driving modules is in the third working mode, wherein the fourth control shunt comprises a fourth thin film transistor, wherein the controlled voltage has a high level and a low level, the initial scanning voltage also has a high level and a low level, the first thin film transistor is a PNP type thin film transistor, the second thin film transistor is an NPN type thin film transistor, the third thin film transistor is an NPN type thin film transistor, and the fourth thin film transistor is a PNP type thin film transistor.

2. The gate-driver-on-array circuit of claim 1, wherein the output control unit has a control voltage and a high level power; the first thin film transistor comprises a first input terminal, a first control terminal, and a first output terminal; the second thin film transistor comprises a second input terminal, a second control terminal, and a second output terminal; the third thin film transistor comprises a third input terminal, a third control terminal, and a third output terminal; the fourth thin film transistor comprises a fourth input terminal, a fourth control terminal, and a fourth output terminal; the first control terminal and the second control terminal connect the control voltage; the first input terminal connects the initial scanning voltage; the first output terminal respectively connects the second output terminal and the third input terminal; the second input terminal connects the high level power; the third control terminal and the fourth control terminal connect the initial scanning voltage; the fourth output terminal connects the fourth control terminal; the third output terminal connects the fourth output terminal; and the fourth output terminal also connects each of the scanning lines.

3. The gate-driver-on-array circuit of claim 1, wherein when each of the gate driving modules is in the first working mode, the initial scanning voltage is a high level, the controlled voltage is a low level, and the switch scanning voltage is equal to the initial scanning voltage; when each of the gate driving modules is in the second working mode, the initial scanning voltage is a high level, the controlled voltage is a high level, and the switch scanning voltage is equal to a voltage of the high level power; and when each of the gate driving modules is in the third working mode, the initial scanning voltage is a low level, and the switch scanning voltage is equal to the initial scanning voltage.

4. The gate-driver-on-array circuit of claim 1, wherein when each of the gate driving modules is in the first working mode, the first thin film transistor is switched on, the second thin film transistor is switched off, the third thin film transistor is switched on, and the fourth thin film transistor is switched off; when each of the gate driving modules is in the second working mode, the first thin film transistor is switched off, the second thin film transistor is switched on, the third thin film transistor is switched on, and the fourth thin film transistor is switched off; and when each of the gate driving modules is in the third working mode, the third thin film transistor is switched off, and the fourth thin film transistor is switched on.

5. A gate-driver-on-array (GOA) circuit, comprising: a plurality of gate driving modules for inputting scanning signals to scanning lines, each of the gate driving modules comprising:

a gate-driver-on-array unit for providing an initial scanning voltage; and an output control unit connecting to the gate-driver-on-array unit, the output control unit comprising:

a first control shunt for controlling a switch scanning voltage, which is associated with the initial scanning voltage, outputted by each of the gate driving modules;

a second control shunt for controlling a switch scanning voltage, which is not associated with the initial scanning voltage, outputted by each of the gate driving modules;

a third control shunt which is used for controlling a turning-on of the first control shunt when each of the gate driving modules is in a first working mode, and is used for controlling a turning-on of the second control shunt when each of the gate driving modules is in a second working mode, wherein each of the gate driving modules has the first working mode, the second working mode, and a third working mode; and a fourth control shunt which is used for controlling an output of the initial scanning voltage when each of the gate driving modules is in the third working mode.

6. The gate-driver-on-array circuit of claim 5, wherein the output control unit has a control voltage and a high level power; the first control shunt comprises a first thin film transistor, the second control shunt comprises a second thin film transistor, the third control shunt comprises a third thin film transistor, and the fourth control shunt comprises a fourth thin film transistor; the first thin film transistor comprises a first input terminal, a first control terminal, and a first output terminal; the second thin film transistor comprises a second input terminal, a second control terminal, and a second output terminal; the third thin film transistor comprises a third input terminal, a third control terminal, and a third output terminal; the fourth thin film transistor comprises a fourth input terminal, a fourth control terminal, and a fourth output terminal; the first control terminal and the second control terminal connect the control voltage; the first input terminal connects the initial scanning voltage; the first output terminal respectively connects the second output terminal and the third input terminal; the second input terminal connects the high level power; the third control terminal and the fourth control terminal connect the initial scanning voltage; the fourth output terminal connects the fourth control terminal; the third output terminal connects the fourth output terminal; and the fourth output terminal also connects each of the scanning lines.

7. The gate-driver-on-array circuit of claim 6, wherein the first thin film transistor is a PNP type thin film transistor, the second thin film transistor is an NPN type thin film transistor, the third thin film transistor is an NPN type thin film transistor, and the fourth thin film transistor is a PNP type thin film transistor.

8. The gate-driver-on-array circuit of claim 6, wherein the controlled voltage has a high level and a low level, and the initial scanning voltage also has a high level and a low level; when each of the gate driving modules is in the first working mode, the initial scanning voltage is a high level, the controlled voltage is a low level, and the switch scanning voltage is equal to the initial scanning voltage; when each of the gate driving modules is in the second working mode, the initial scanning voltage is a high level, the controlled voltage is a high level, and the switch scanning voltage is equal to a voltage of the high level power; and when each of the gate driving modules is in the third working mode, the initial scanning voltage is a low level, and the switch scanning voltage is equal to the initial scanning voltage.

9. The gate-driver-on-array circuit of claim 6, wherein when each of the gate driving modules is in the first working mode, the first thin film transistor is switched on, the second thin film transistor is switched off, the third thin film transistor is switched on, and the fourth thin film transistor is switched off; when each of the gate driving modules is in the second working mode, the first thin film transistor is switched off, the second thin film transistor is switched on, the third thin film transistor is switched on, and the fourth thin film transistor is switched off; and when each of the gate driving modules is in the third working mode, the third thin film transistor is switched off, and the fourth thin film transistor is switched on.

10. A liquid crystal display device, comprising:

a gate-driver-on-array (GOA) circuit comprising: a plurality of gate driving modules for inputting scanning signals to scanning lines, each of the gate driving modules comprising:

a gate-driver-on-array unit for providing an initial scanning voltage; and an output control unit connecting to the gate-driver-on-array unit, the output control unit comprising:

a first control shunt for controlling a switch scanning voltage, which is associated with the initial scanning voltage, outputted by each of the gate driving modules;

a second control shunt for controlling a switch scanning voltage, which is not associated with the initial scanning voltage, outputted by each of the gate driving modules;

a third control shunt which is used for controlling a turning-on of the first control shunt when each of the gate driving modules is in a first working mode, and is used for controlling a turning-on of the second control shunt when each of the gate driving modules is in a second working mode, wherein each of the gate driving modules has the first working mode, the second working mode, and a third working mode; and a fourth control shunt which is used for controlling an output of the initial scanning voltage when each of the gate driving modules is in the third working mode.

11. The liquid crystal display device of claim 10, wherein the output control unit has a control voltage and a high level power; the first control shunt comprises a first thin film transistor, the second control shunt comprises a second thin film transistor, the third control shunt comprises a third thin film transistor, and the fourth control shunt comprises a fourth thin film transistor; the first thin film transistor comprises a first input terminal, a first control terminal, and a first output terminal; the second thin film transistor comprises a second input terminal, a second control terminal, and a second output terminal; the third thin film transistor comprises a third input terminal, a third control terminal, and a third output terminal; the fourth thin film transistor comprises a fourth input terminal, a fourth control terminal, and a fourth output terminal; the first control terminal and the second control terminal connect the control voltage; the first input terminal connects the initial scanning voltage; the first output terminal respectively connects the second output terminal and the third input terminal; the second input terminal connects the high level power; the third control terminal and the fourth control terminal connect the initial scanning voltage; the fourth output terminal connects the fourth control terminal; the third output terminal connects the fourth output terminal; and the fourth output terminal also connects each of the scanning lines.

12. The liquid crystal display device of claim 11, wherein the first thin film transistor is a PNP type thin film transistor, the second thin film transistor is an NPN type thin film transistor, the third thin film transistor is an NPN type thin film transistor, and the fourth thin film transistor is a PNP type thin film transistor.

13. The liquid crystal display device of claim 11, wherein the controlled voltage has a high level and a low level, and the initial scanning voltage also has a high level and a low level; when each of the gate driving modules is in the first working mode, the initial scanning voltage is a high level, the controlled voltage is a low level, and the switch scanning voltage is equal to the initial scanning voltage; when each of the gate driving modules is in the second working mode, the initial scanning voltage is a high level, the controlled voltage is a high level, and the switch scanning voltage is equal to a voltage of the high level power; and when each of the gate driving modules is in the third working mode, the initial scanning voltage is a low level, and the switch scanning voltage is equal to the initial scanning voltage.

14. The liquid crystal display device of claim 11, wherein when each of the gate driving modules is in the first working mode, the first thin film transistor is switched on, the second thin film transistor is switched off, the third thin film transistor is switched on, and the fourth thin film transistor is switched off; when each of the gate driving modules is in the second working mode, the first thin film transistor is switched off, the second thin film transistor is switched on, the third thin film transistor is switched on, and the fourth thin film transistor is switched off; and when each of the gate driving modules is in the third working mode, the third thin film transistor is switched off, and the fourth thin film transistor is switched on.

* * * * *